US008066931B2

(12) United States Patent
Nørgaard

(10) Patent No.: US 8,066,931 B2
(45) Date of Patent: Nov. 29, 2011

(54) METHOD AND AN APPARATUS FOR THE MANUFACTURE OF CONCRETE PIPES

(75) Inventor: Morten Nørgaard, Pandrup (DK)

(73) Assignee: Pedershaab Concrete Technologies A/S, Bronderslev (DK)

( * ) Notice: Subject to any disclaimer, the term of this patent is extended or adjusted under 35 U.S.C. 154(b) by 1371 days.

(21) Appl. No.: 10/540,235

(22) PCT Filed: Jan. 7, 2004

(86) PCT No.: PCT/DK2004/000002

§ 371 (c)(1),
(2), (4) Date: Jun. 21, 2005

(87) PCT Pub. No.: WO2004/062867

PCT Pub. Date: Jul. 29, 2004

(65) Prior Publication Data

US 2006/0033227 A1 Feb. 16, 2006

(30) Foreign Application Priority Data

Jan. 10, 2003 (DK) ..... 2003 00013

(51) Int. Cl.

| | |
|---|---|
| ***B28B 1/00*** | (2006.01) |
| ***B28B 1/08*** | (2006.01) |
| ***B28B 1/30*** | (2006.01) |
| ***B28B 13/00*** | (2006.01) |
| *B28B 7/36* | (2006.01) |
| *B28B 7/38* | (2006.01) |
| *B28B 17/00* | (2006.01) |

(52) U.S. Cl. ..... 264/333; 425/456

(58) Field of Classification Search ..... 264/333
See application file for complete search history.

(56) References Cited

U.S. PATENT DOCUMENTS

| | | | | |
|---|---|---|---|---|
| 1,694,563 | A * | 12/1928 | Ross et al. | 264/71 |
| 2,220,975 | A | 11/1940 | O'Rahilly | |
| 2,356,852 | A | 8/1944 | Hutchinson | |
| 3,217,077 | A * | 11/1965 | Cocke | 264/256 |
| 4,039,642 | A * | 8/1977 | Steiro | 264/71 |
| 5,051,223 | A * | 9/1991 | Kern | 264/256 |

FOREIGN PATENT DOCUMENTS

| | | |
|---|---|---|
| DE | 1646760 | 2/1971 |
| DE | 3115985 A1 | 11/1982 |
| SU | 688342 | 9/1979 |
| WO | WO 92/18309 | 10/1992 |

* cited by examiner

*Primary Examiner* — Christina Johnson
*Assistant Examiner* — Patrick Butler
(74) *Attorney, Agent, or Firm* — William J. Sapone; Coleman Sudol Sapone P.C.

(57) ABSTRACT

A method and an apparatus for the manufacture of concrete pipes (2) made of an outer layer and having an inner layer of greater density in surface structure is described. The inner layer is applied by an applicator in a mould (1) having both outer (3) and inner (4) mould parts. The applicator is formed by an inner mould part or core (4) or by an applicator unit in immediate connection with the core (4). The applicator applies the inner layer simultaneously or immediately following vibration of the concrete forming the pipe. The inner layer is applied during movement of the inner mould part or core (4) in its longitudinal direction, the core having one or more supply openings (14) provided along the circumference of the core (4) at the upper end of the core (4) for supplying a further material of greater density to form the inner layer.

18 Claims, 6 Drawing Sheets

METHOD AND AN APPARATUS FOR THE MANUFACTURE OF CONCRETE PIPES

TECHNICAL FIELD

The invention relates to a method for the manufacture of concrete pipes made of an outer layer, said outer layer forming the pipe itself, as well as an inner layer of greater density in surface structure, the inner layer being supplied by an applicator in a mould having inner as well as outer mould parts.

The invention also relates to an apparatus for the manufacture of concrete pipes using an applicator formed by an inner mould part or core (4) or by an applicator unit in direct connection with the core, the applicator supplying the inner layer simultaneously or immediately following vibration of the outer layer.

BACKGROUND

Concrete pipes, which are normally used for the discharge of wastewater via sewers as well as for the discharge of rainwater, are generally manufactured such that the pipe exclusively consists of the base concrete which is used for the casting of the pipe.

Since the development within the field of environment and wastewater has involved the separation of wastewater and rainwater, rainwater by-passes the cleaning systems passing through separate conduits to reduce the load on the wastewater cleaning systems, a concentration of the wastewater increases at the same time, which means that the wastewater is even more corrosive for the concrete pipes than before.

To prevent the corrosive wastewater from attacking the concrete pipes, it has been attempted to line the pipes with a material other than concrete for the manufacture of what is called lined pipes. Such a lining may be carried out in several different ways, but generally it is done in that the lining is placed on the core in the mould, following which the concrete pipe is cast and removed from the mould in a conventional manner, which means that the cast pipe and the outer form are lifted off the core, and the outer form is lifted off the pipe.

In addition to increased manufacturing costs and problems of density when joining the pipes to a conduit, this also involves a reduction of the capacity in the manufacture of such pipes. U.S. Pat. No. 5,051,223 discloses another method of manufacturing corrosion resistant concrete pipes. Here, use is made of a radial pressing head which is basically composed of a plurality of oppositely running rolls which form the internal part of a concrete pipe. The external part is formed in an ordinary manner by means of an outer form.

Concrete is poured into the mould, while the radial pressing head is run up through the vertically positioned outer form. When the radial pressing head with its oppositely running rolls runs up through the outer form, these oppositely running rolls form the inner surface of the pipe. A smoothing device is provided at a fixed distance after the oppositely running rolls, seen in the direction of travel of the radial pressing head, an impregnation liquid supplied to the internal surface of the concrete pipe by the smoothing device. This impregnation liquid is supplied while the concrete is still wet, whereby the impregnation liquid in the subsequent smoothing permeates about 10 mm into the inner surface of the pipe wall. This subsequent smoothing, also called polishing, takes place after the pipe has been formed.

Today, however, a large number of concrete pipes are manufactured according to a different method, viz. by the so-called vibration method. For this manufacturing method, it is not possible to use the above-mentioned known technique for the manufacture of corrosion resistant concrete pipes.

In the manufacture of concrete pipes according to the vibration casting method, the technique may again be divided into two methods, viz. the method with a rising core and the method with a fixed core.

In the rising core method, as shown for example in European Patent No. 0 674 573 B, the casting machine comprises a casting mould which basically consists of an outer formwork in the form of an outer form, an inner formwork in the form of a core, a bottom formwork in the form of a bottom ring and a feed system. In addition, there is a profile ring for the forming of the spigot end of the pipe, defining the upward boundary of the casting mould.

In the making of the pipe, vibration is applied via vibration means which may be arranged in the core, on the outer form or as table vibration, where the core or outer form stands on a vibrating table.

In the manufacture of a pipe according to the rising core method, the casting process basically takes place in that the core is moved up through the bottom ring, following which it is stopped, the core being present at a certain height in the mould. Then, concrete is poured into the mould from its upper part. Subsequently, the core is moved continuously up through the mould while concrete is being filled into the mould. The concrete is distributed and compacted during the process by a rotor arranged on the top of the core, while the concrete is vibrated under the action of a strong vibrator, normally arranged centrally in the core. A profile ring is arranged at the upper end of the outer form, and when the mould is filled with concrete, this profile ring defines the upper boundary of the mould, together with the outer form and the core. When the mould has been filled with concrete, pressing is performed, and then the profile ring is rotated slightly to and fro in order to smooth the spigot end. One of the effects of this casting process is that it ensures that the manufactured pipes have the same length.

In the manufacture of pipes according to the fixed core method, the casting process basically takes place in that the core is fixedly positioned, and that an outer form having a bottom ring clamped thereto is arranged over the core. The concrete is then poured down into the mould from above, while vibration is applied to the mould. When the mould has been filled, a profile ring is moved down at the top of the mould, and thereby the spigot end of the pipe is formed. Then the core is removed from the mould by means of a crane or similar lifting tool which positions the pipe, bottom ring and outer form for setting at a suitable location, where the outer form is loosened from the bottom ring and the crane lifts the outer form off and away.

Accordingly, the object of the invention is to provide a method of manufacturing concrete pipes with an inner surface, where the properties are improved with respect to surface quality, e.g. in that the inner surface exhibits a greater corrosion resistance, better flow properties and a more attractive surface structure.

A further object of the invention is to provide an apparatus for the manufacture of such pipes.

The method of the invention, ensures that when the pipe itself has been formed, a further layer of greater structural density is applied to the inner side of the pipe through the inner mould part, the so-called core, via nozzles or gaps, while the mould and thereby the concrete are vibrated. Vibration of the mould keeps it in a form of a fluid phase. When the concrete is maintained in such a fluid phase during the feeding of material of greater structural density, the effect is achieved that the two materials merge to a mutually denser structure, thereby providing a tighter bond between the two materials.

An advantageous way of feeding the material of greater density in structure, is by feeding the further material through the inner mould part, the core, while it is displaced into the outer mould part, feed openings being provided in the core along its circumference at the upper end of the core for the supply of the further material.

A method is described where the applicator in the apparatus is formed by a core which is rotated after the forming of the pipe, a further layer being applied internally to the pipe from one or more rows of nozzles. In this case, the apparatus for the performance of the method is preferably of the fixed core type.

A method is described where the applicator for the application of the inner layer is formed by the rotor, which is also used for forming the pipe beforehand. At its lower part, the rotor is provided with one or more supply openings for the further material.

A method is described where the inner layer is applied to a top and/or bottom ring before these are applied to the other mould parts. This ensures that the parts of the finished concrete pipe which will constitute the parts to be joined in the laying of a pipeline, also have a surface of greater density than the outer surface of the concrete pipe.

A similar method is also described but where the further layer is applied to the bottom and/or top ring after the bottom and/or top ring has been connected with the other mould parts, and before the mould is filled with concrete.

An embodiment of the method is also described where the spigot end of the pipe is provided with the further material to form the inner layer of greater structural density.

The further material may be fed in the form of a paste, powder or liquid.

An apparatus is defined for the performance of the method, where the core, according to the rising core principle, constitutes the applicator. The further material is fed through one or more annular grooves, said grooves extending along the circumference of the core and being arranged at the front end of the core seen in the direction of travel of the core.

An apparatus is also defined with an applicator for a core according to the rising core principle, where the annular groove or grooves are formed with a plurality of nozzles or gaps for the supply of the further material.

An apparatus is also defined with an applicator according to the fixed core principle, where the core is rotated after or during the forming of the pipe. The core is provided with one or more grooves which extend in the longitudinal direction of the core, said groove or grooves extending in the entire effective length of the core. The further material is fed though the groove or grooves adapted for the purpose, while the core is rotated about its longitudinal axis. The core is rotated at least enough so that the entire inner surface of the pipe is covered by the further material.

The apparatus as described above may have the groove or grooves extend as straight grooves in the longitudinal direction of the core.

The apparatus may have the groove or grooves extend in a form of a spiral along the surface of the core in the longitudinal direction.

An apparatus is further defined where the applicator is placed on a rotor in the lower part thereof, so that the further material is fed to the inner surface of the pipe by means of a plurality of nozzles or gaps, just after the pipe itself has been formed.

The further material is preferably fed under pressure and while the mould and/or pipe are vibrated. The pressure may be provided by the supply of the further material, or may optionally be applied by an expedient configuration of the core in connection with the provided gap or gaps in the surface of the core.

BRIEF DESCRIPTION OF THE DRAWINGS

The invention will be described more fully below with reference to the drawing, where.

DETAILED DESCRIPTION OF THE INVENTION

Figure 1:
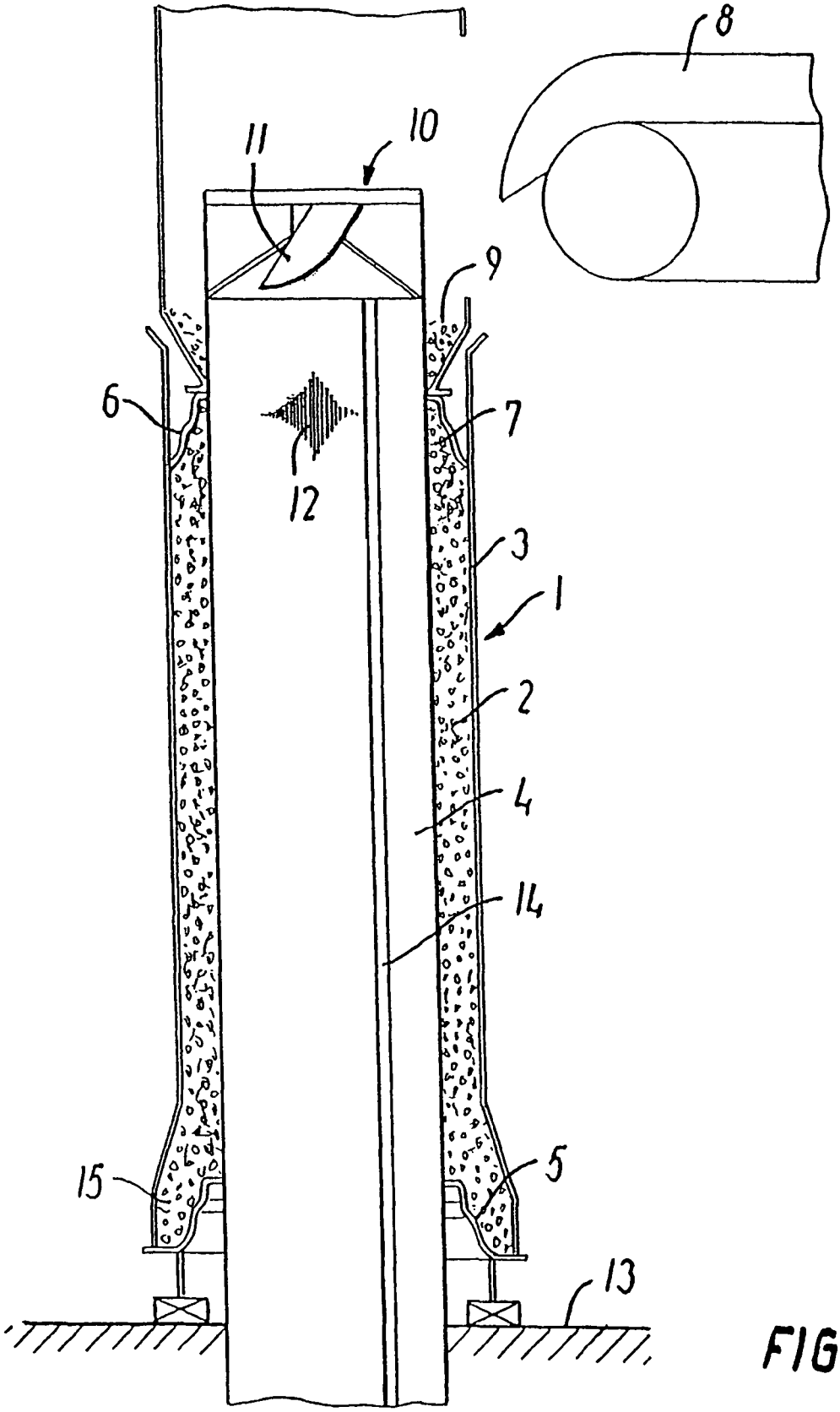
FIG. 1 shows an apparatus for the casting of concrete pipes with an inner layer of greater density in structure, where the applicator is formed by a longitudinal gap in the core.

Preferred embodiments of the invention are now described, where use is made of a casting mould 1 for the casting of a concrete pipe 2, the casting mould 1 comprising an outer formwork in the form of an outer form 3, an inner formwork in the form of a core 4, a bottom formwork in the form of a bottom ring 5, a top formwork in the form of a profile ring or top ring 6 for forming the spigot end 7 of the pipe 2, and a feed system 8 for the supply of concrete 9. Vibration is applied in connection with the casting mould. This is done in a preferred embodiment by means of a vibrator 12 preferably arranged in the core 4. The vibration may be applied from an external source of vibration and optionally from a vibration table.

When a pipe 2 is to be cast by means of the rising core principle, this roughly takes place in that concrete 9 is poured via the feed system 8 into the mould 1, where the outer form 3 rests on the bottom ring 5 which stands on a substrate 13. The rotor 10 is rotated about a longitudinal axis which extends through the center of the core 4. When rotating, the rotor 10 presses the concrete against the inner side of the outer form 3, whereby the pipe 2 is formed, while the core 4 moves—rises—into the outer form 3. The vibration from the vibrator 12 contributes to making the concrete 9 more uniform and dense. The length of the pipe 2 is determined by the position of the profile ring 6 in the outer form 3, and when the rotor 10 passes through the profile ring 6, it simultaneously casts the spigot end 7 of the pipe 2, which ensures that the pipes 2 have a uniform length. The surface of the spigot end 7 is finished in that the profile ring/top ring 6 is rotated and pressed on to the spigot end 7 of the pipe 2, the spigot end 7 being smoothed thereby.

A pipe may also be cast according to a fixed core principle. This principle differs from the rising core principle in that the core has been placed in the mould in advance and is not movable in its longitudinal direction. When the concrete is poured into the mould by generally used distribution means, said mould consisting of a core, outer form, bottom ring and top ring, vibration is applied from a vibrator, which is preferably arranged in the core, but may also be applied from an external vibrator or optionally from a vibration table.

According to the invention, a plurality of nozzles and/or gaps 14 are provided on the core 4, in case of the rising core as well as the fixed core, to supply a further material, so that the further material is supplied to the internal or inner surface of the concrete pipe 2 just formed.

To ensure that the spigot end 7 and the socket 15 of the pipe 2 are also provided with a further material, the further material may be supplied to both the profile ring 6 and the bottom ring 5 before they are applied to the outer form 3. This may be done by supplying the further material by supply means from the core 4, from the outer form 3 or optionally by precoating the profile ring 6 and/or the bottom ring 5. The supply of the further material to the spigot end 7 may also take place in that the profile ring 6 is lifted and then the further material is filled by supply means over the spigot end 7 of the pipe 2, following which the profile ring 6 is lowered or pressed down over the spigot end 7 simultaneously or immediately following the vibration.

Figure 2:
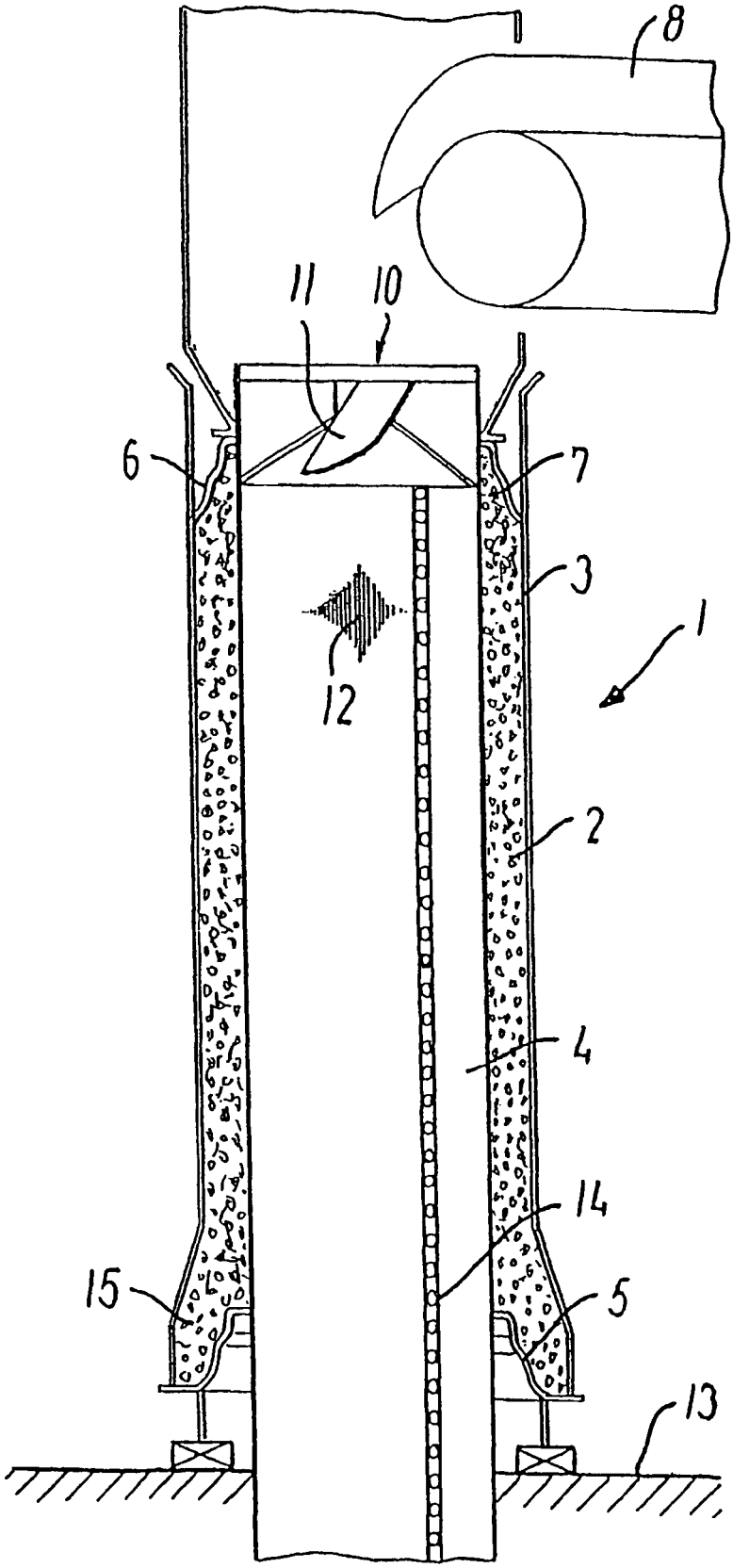
FIG. 2 shows an apparatus for the casting of concrete pipes with an inner layer of greater structural density, where the applicator in the core is formed by a longitudinal gap with a plurality of nozzles.

In a preferred embodiment of the arrangement of nozzles and/or gaps 14 on the core, as shown in FIGS. 1 and 2, the nozzles and/or gaps 14 are arranged in the longitudinal direction of the core 4, and the further material is fed to the pipe 2 by rotation of the core 4 about its longitudinal axis.

Figure 3:
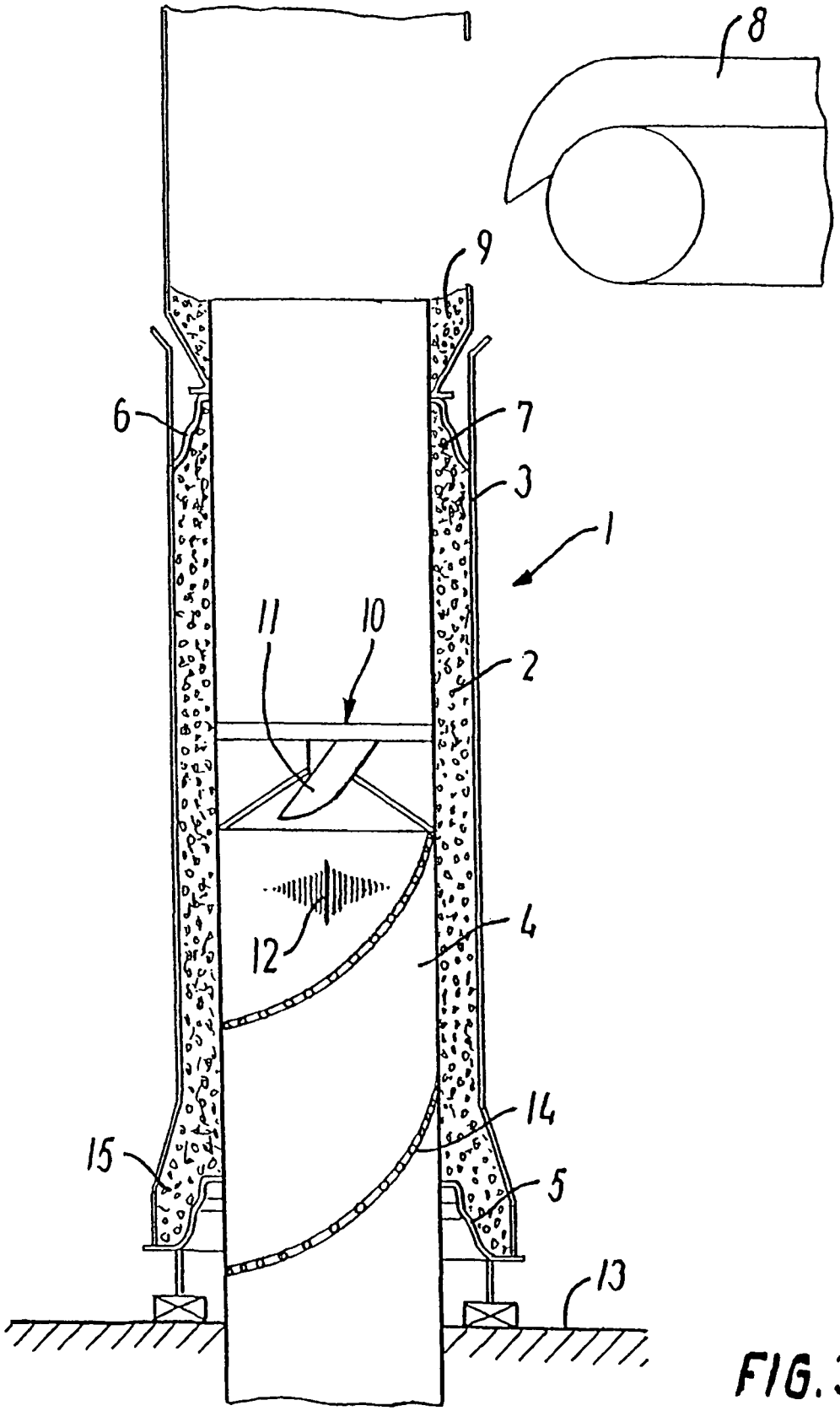
FIG. 3 shows an apparatus for the casting of concrete pipes with an inner layer of greater structural density, where the applicator is formed by a gap twisted along the surface of the core with a plurality of nozzles in the gap.

In another preferred embodiment of the arrangement of nozzles and/or gaps 14 on the core 4, as shown in FIG. 3, the nozzles and/or gaps 14 are arranged in a groove which is twisted in a form of a spiral or threads in the longitudinal direction of the core 4. Here, too, the further material is fed to the inner surface of the pipe by rotation of the core 4 about its longitudinal axis. In this case, the rotation may optionally be supplemented by a movement in the longitudinal direction.

The embodiments of the arrangement of nozzles and/or gaps on the core 4 according to FIGS. 1, 2, and 3 may advantageously also be used in the supply of the further material with the fixed core casting principle. In this case, the core will then be positioned in the casting mould, and after the mould has been filled with concrete 9, the core 4 will be rotated about its own longitudinal axis either during vibration or immediately following vibration, while the further material is supplied through the nozzles and/or gaps arranged in the core 4.

The core is rotated such that the row or rows of nozzles supplying the further material to the pipe are moved precisely so far that the supplied material covers the entire inner side of the pipe.

Figure 4:
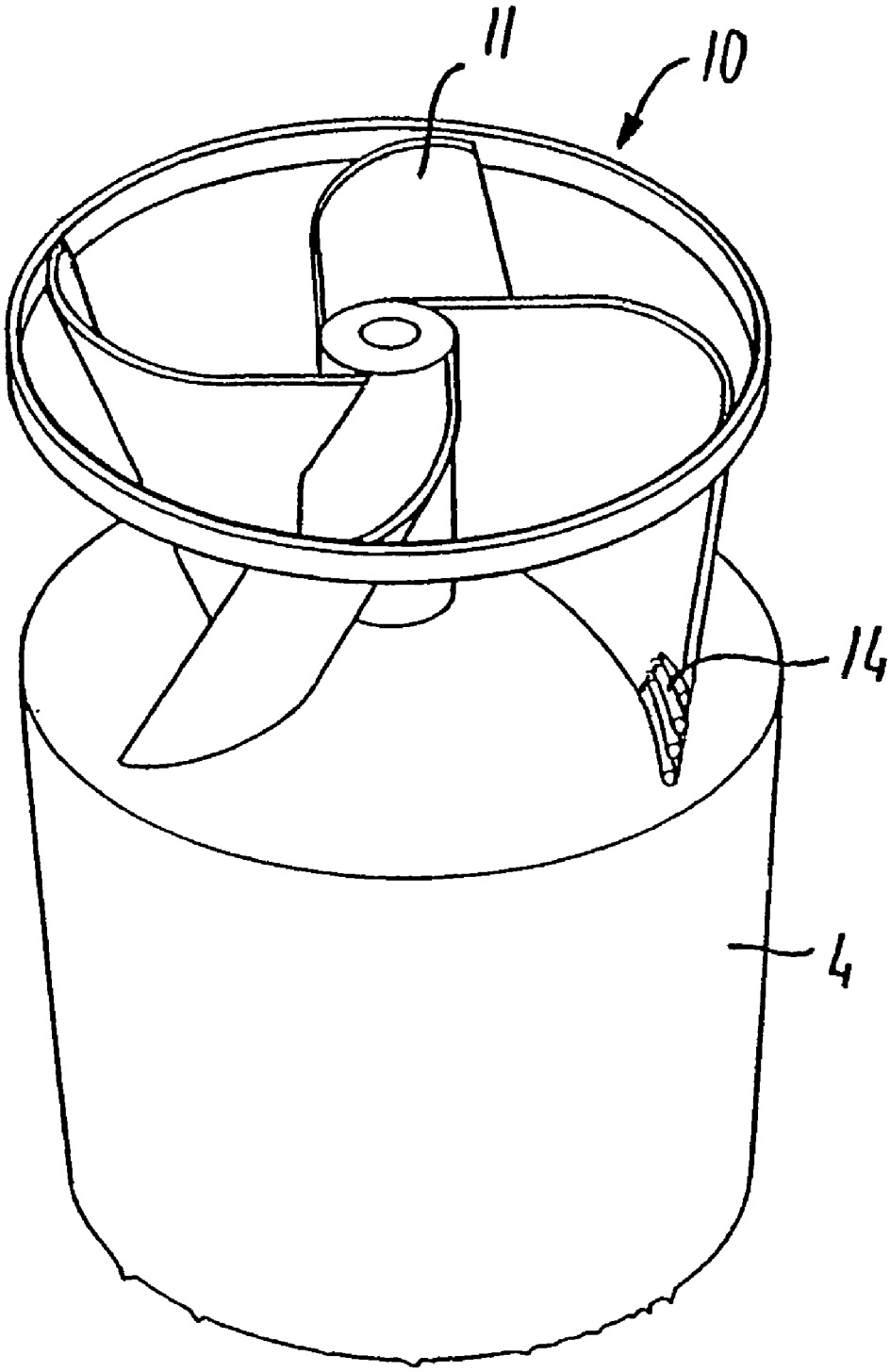
FIG. 4 shows an apparatus for the casting of concrete pipes with an inner layer of greater structural density, where the applicator is formed by the lower part of the rotor.

In a third preferred embodiment of the arrangement of nozzles and/or gaps 14, as shown in FIG. 4, these are placed on the rotor 10 on the lower end thereof, so that the supply of the further material takes place during the rotation of the rotor 10. The rotor 10 is provided with suitable means (not shown) for providing a plurality of nozzles and/or gaps with the further material which is to be applied to the inner surface of the pipe 2. The supply may take place through channels formed in the blades 11 of the rotor 10, or through supply channels extending from an area near the center of the rotor 10 to an area near the circumference of the rotor 10.

Figure 5:
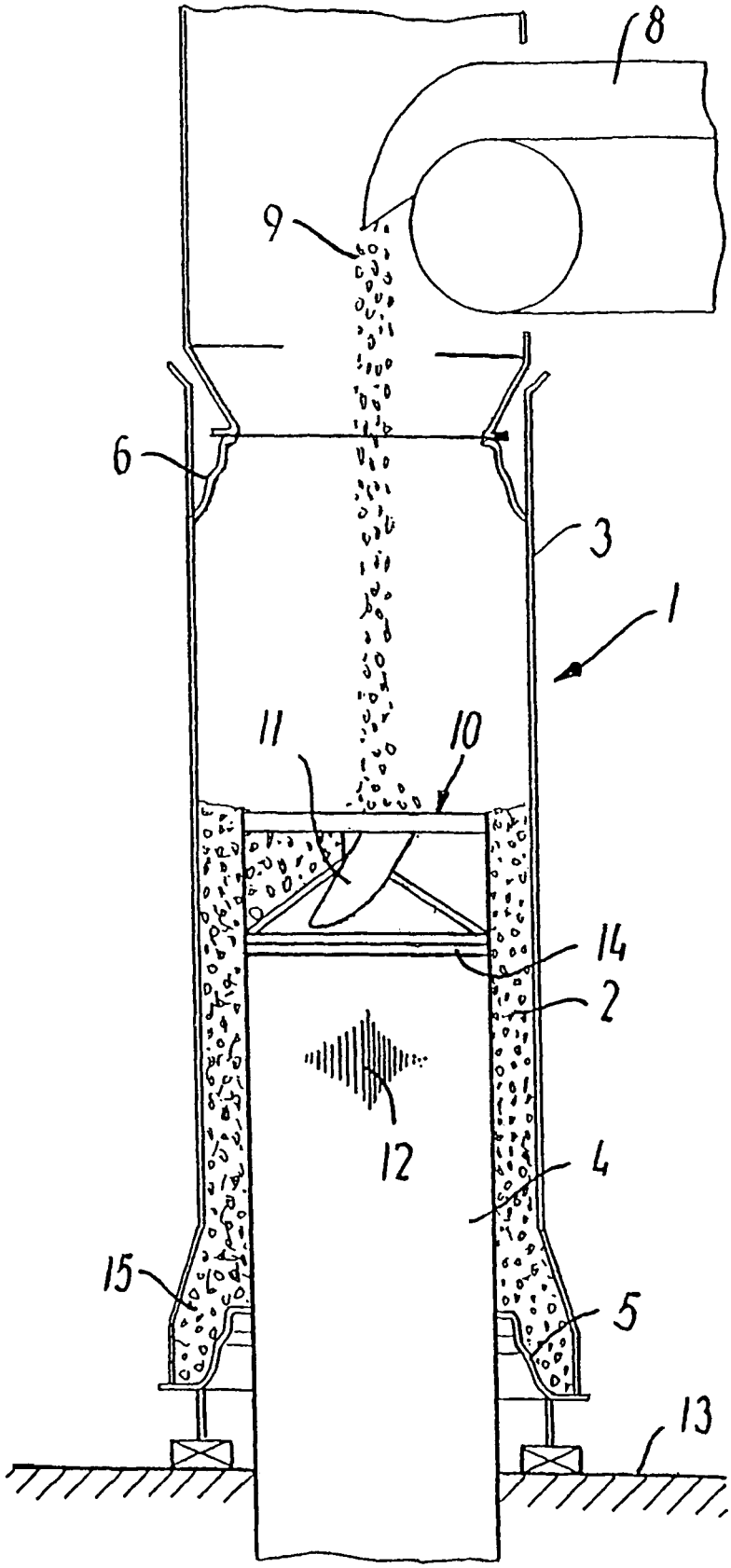
FIG. 5 shows an apparatus for the casting of concrete pipes with an inner layer of greater structural density, where the applicator in the core is formed by a gap which extends along the circumference, and which is present in the upper end of the core.
Figure 6:
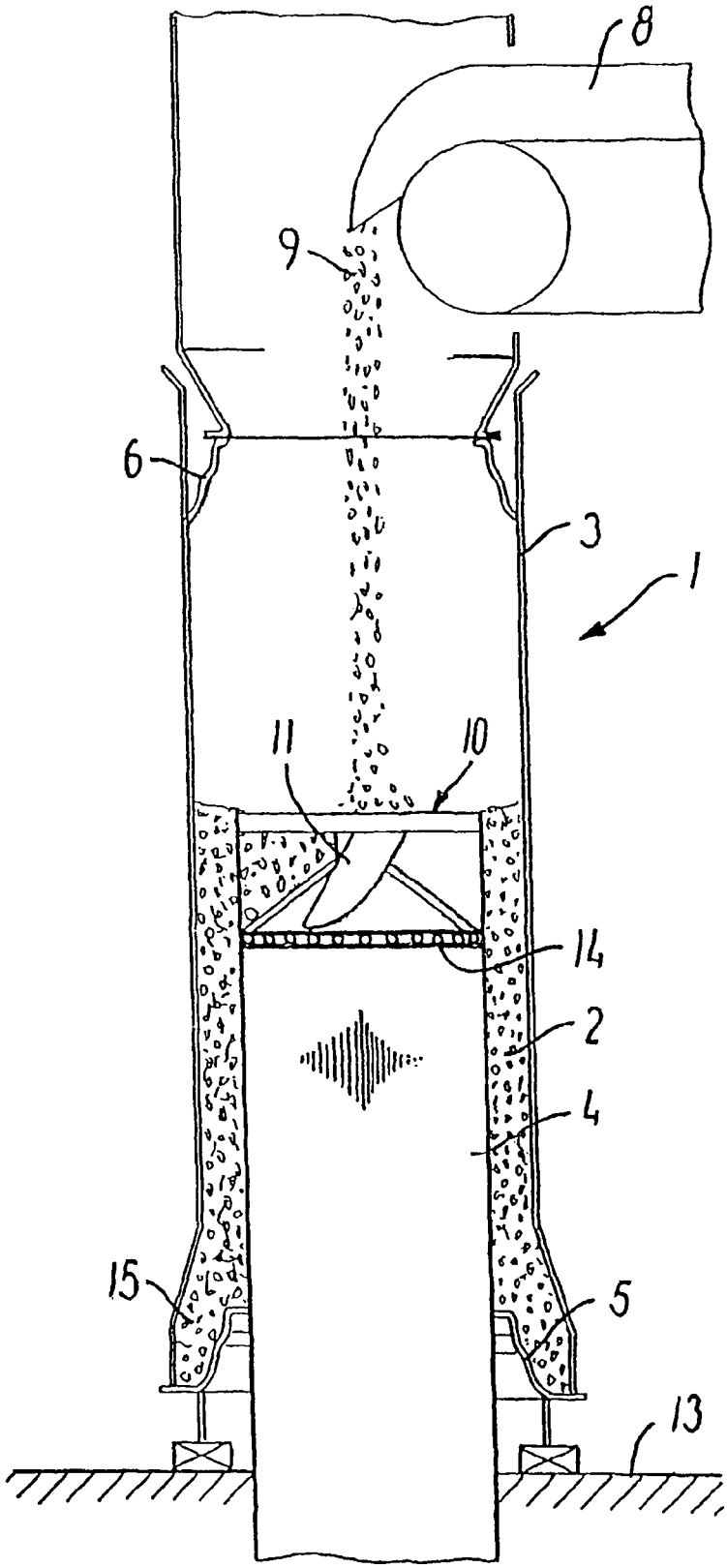
FIG. 6 shows an apparatus for the casting of concrete pipes with an inner layer of greater structural density, where the applicator in the core is formed by a gap which extends along the circumference, and which has a plurality of nozzles therein and is present at the upper end of the core.

In a fourth preferred embodiment of the arrangement of nozzles and/or gaps 14, as shown in FIGS. 5 and 6, these nozzles and/or gaps are arranged in an annular groove 14 which extends along the circumference of the core 4. The annular groove 14 is preferably arranged at the front end of the core 4 in the direction of travel of the core 4. In case that it is not possible to move sufficient material through this one annular groove 14, several annular grooves may be arranged in the immediate vicinity of the first annular groove Supply of the further material during or immediately following vibration provides the effect that the further material is joined with the concrete in such a manner that a form of diffusion of the two materials into each other occurs, so that a type of sliding transition from the concrete and out into the further material takes place. This ensures a strong bond between the joined materials.

When a pipe has been cast, it is removed from the mould in the usual manner, which means that with the rising core principle the core is moved down to the starting position, the profile ring at the top of the pipe and the outer form are removed so that the pipe stands on the bottom ring ready for transport to a setting area or the like. Here, it may be decided to allow the profile ring to remain on the top of the pipe during the finish setting to achieve even better tolerances on the spigot end of the pipe. This, however, will require use of more profile rings.

When removing the pipe from the mould with the fixed core principle, the pipe, bottom ring and outer form are lifted off the core by means of a crane and are placed in a setting location adapted for the purpose. At the setting location, the outer form is loosened from the bottom ring, and the outer form is lifted off the pipe by a crane or the like.

In an optional further embodiment, it is conceivable that the further material is supplied only to a portion of the circumference of the pipe, so that the further material just covers the inner part of the pipe, which will face downwards when the pipe is positioned substantially horizontally with the inclination required for the flow of water, wastewater or the like. In the rising core embodiment, this may optionally be done by blocking the part of the gap or the nozzles which are not to receive any further layer. In the fixed core embodiment, it is sufficient to rotate the core just one half of a rotation or as far as is found necessary. In the embodiment where the applicator is formed by the rotor, the supply to the nozzles may be blocked in a controlled manner, so that the further material is just fed through the nozzles when the nozzles are at the area to which the further material is to be supplied.

What is claimed is:

1. A method for manufacturing a lined concrete pipe comprised of an outer concrete layer and an inner liner layer containing a further material which forms a greater density inner surface liner, said method comprising:

providing an outer mould part and a core, a space formed between the outer mould part and the core having a shape of the lined concrete pipe, the core being movable upwardly through the outer mould part;

providing a vibrator within the core, feeding concrete to the space formed between the outer mould part and the core as the core moves upwardly within the outer mould part for filling the space with concrete, providing the core with an applicator comprising one or more supply openings positioned for delivering the further material below the concrete supplied to the space, vibrating the concrete filling the space between the outer mould part and the core for maintaining the concrete in a fluid phase as the concrete is filling the space while simultaneously supplying the further material through the supply openings of the applicator for merging and diffusing the further material into the adjacent fluidized concrete, and at least partially rotating the applicator and the core during delivery of the concrete and further material for merging and diffusing the further material into the concrete adjacent the applicator to provide a sliding transition from the concrete and out to the further material, forming a mutually denser structural liner with a tight bond, the liner integrating together the concrete and further material, thereby forming an integral liner with the concrete pipe, providing a greater density surface on at least a portion of an inner surface of the concrete pipe; and, delivering the further material for applying an inner layer to a bottom ring and/or a top ring and then applying said ring or rings to the core and the outer mould part.

2. The method of claim 1 wherein the applicator is integrally formed with the core or by an applicator unit in direct connection with the core.

3. The method according to claim 1 wherein the further material is delivered in the form of a paste, powder or liquid.

4. The method according to claim 1 wherein the one or more supply openings essentially extend in the longitudinal direction of the core.

5. The method according to claim 1 further comprising forming the core with the one or more supply openings located along the circumference of the core at an upper end of the core.

6. The method according to claim 1 wherein the applicator is in a form of a rotor, the rotor having the one or more supply openings provided in a lower part of the rotor.

7. A method for manufacturing a lined concrete pipe comprised of an outer concrete layer and an inner liner layer containing a further material which forms a greater density inner surface liner, said method comprising:

providing an outer mould part and a core, a space formed between the outer mould part and the core having a shape of the lined concrete pipe, the core being movable upwardly through the outer mould part;

providing a vibrator within the core, feeding concrete to the space formed between the outer mould part and the core as the core moves upwardly within the outer mould part for filling the space with concrete, providing the core with an applicator comprising one or more supply openings positioned for delivering the further material below the concrete supplied to the space, vibrating the concrete filling the space between the outer mould part and the core for maintaining the concrete in a fluid phase as the concrete is filling the space while simultaneously supplying the further material through the supply openings of the applicator for merging and diffusing the further material into the adjacent fluidized concrete, and at least partially rotating the applicator and the core during delivery of the concrete and further material for merging and diffusing the further material into the concrete adjacent the applicator to provide a sliding transition from the concrete and out to the further material, forming a mutually denser structural liner with a tight bond, the liner integrating together the concrete and further material, thereby forming an integral liner with the concrete pipe, providing a greater density surface on at least a portion of an inner surface of the concrete pipe; and, delivering the further material for applying the inner layer to a bottom ring and/or a top ring when said ring or rings have been connected with the core and outer mould part and before the space is filled with concrete.

8. The method according to claim 7 wherein the applicator is integrally formed with the core or by an applicator unit in direct connection with the core.

9. The method according to claim 7 wherein the further material is delivered in the form of a paste, powder or liquid.

10. The method according to claim 7 wherein the one or more supply openings essentially extend in the longitudinal direction of the core.

11. The method according to claim 7 further comprising forming the core with the one or more supply openings located along the circumference of the core at an upper end of the core.

12. The method according to claim 7 wherein the applicator is in a form of a rotor, the rotor having the one or more supply openings provided in a lower part of the rotor.

13. A method for manufacturing a lined concrete pipe comprised of an outer concrete layer and an inner liner layer containing a further material which forms a greater density inner surface liner, said method comprising:

providing an outer mould part and a core, a space formed between the outer mould part and the core having a shape of the lined concrete pipe, the core being movable upwardly through the outer mould part;

providing a vibrator within the core, feeding concrete to the space formed between the outer mould part and the core as the core moves upwardly within the outer mould part for filling the space with concrete, providing the core with an applicator comprising one or more supply openings positioned for delivering the further material below the concrete supplied to the space, vibrating the concrete filling the space between the outer mould part and the core for maintaining the concrete in a fluid phase as the concrete is filling the space while simultaneously supplying the further material through the supply openings of the applicator for merging and diffusing the further material into the adjacent fluidized concrete, and at least partially rotating the applicator and the core during delivery of the concrete and further material for merging and diffusing the further material into the concrete adjacent the applicator to provide a sliding transition from the concrete and out to the further material, forming a mutually denser structural liner with a tight bond, the liner integrating together the concrete and further material, thereby forming an integral liner with the concrete pipe, providing a greater density surface on at least a portion of an inner surface of the concrete pipe; and, wherein the pipe has a spigot end, and further comprising delivering the further material for applying an inner layer to the spigot end, lifting a top ring or a profile ring, filling the further material over the spigot end of the pipe, and then lowering/pressing down the profile ring over the spigot end simultaneous with or immediately following vibration.

14. The method according to claim 13 wherein the applicator is integrally formed with the core or by an applicator unit in direct connection with the core.

15. The method according to claim 13 wherein the further material is delivered in the form of a paste, powder or liquid.

16. The method according to claim 13 wherein the one or more supply openings essentially extend in the longitudinal direction of the core.

17. The method according to claim 13 further comprising forming the core with the one or more supply openings located along the circumference of the core at an upper end of the core.

18. The method according to claim 13 wherein the applicator is in a form of a rotor, the rotor having the one or more supply openings provided in a lower part of the rotor.

* * * * *